US010587057B2

(12) United States Patent
Ishikawa et al.

(10) Patent No.: US 10,587,057 B2
(45) Date of Patent: Mar. 10, 2020

(54) TERMINAL, AND ELECTRICAL CONNECTOR

(71) Applicant: J.S.T. Mfg. Co., Ltd., Osaka-shi (JP)

(72) Inventors: Takahiro Ishikawa, Osaka (JP); Masaaki Ishigami, Osaka (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 16/042,263

(22) Filed: Jul. 23, 2018

(65) Prior Publication Data

US 2019/0036236 A1 Jan. 31, 2019

(30) Foreign Application Priority Data

Jul. 25, 2017 (JP) ..... 2017-143465

(51) Int. Cl.

| | |
|---|---|
| ***H01R 4/24*** | (2018.01) |
| ***H01R 4/48*** | (2006.01) |
| ***H01R 12/58*** | (2011.01) |
| ***H01R 13/428*** | (2006.01) |
| ***H01R 12/77*** | (2011.01) |
| ***H01R 13/11*** | (2006.01) |
| ***H01R 13/432*** | (2006.01) |
| *H01R 13/18* | (2006.01) |

(52) U.S. Cl.

CPC ..... *H01R 4/4836* (2013.01); *H01R 4/4818* (2013.01); *H01R 12/58* (2013.01); *H01R 12/778* (2013.01); *H01R 13/113* (2013.01); *H01R 13/428* (2013.01); *H01R 13/432* (2013.01); *H01R 13/18* (2013.01)

(58) Field of Classification Search

CPC .... H01R 13/113; H01R 13/18; H01R 13/428; H01R 4/4836; H01R 12/58; H01R 12/778

USPC ..... 439/441

See application file for complete search history.

(56) References Cited

U.S. PATENT DOCUMENTS 4,566,749 A * 1/1986 Johnston ..... H01R 4/62 439/425
5,679,021 A * 10/1997 Kramer ..... H01R 4/4845 439/789
6,280,233 B1 * 8/2001 Beege ..... H01R 4/4827 439/441

(Continued)

FOREIGN PATENT DOCUMENTS

JP 2009-531815 A 9/2009

*Primary Examiner* — Abdullah A Riyami
*Assistant Examiner* — Vladimir Imas
(74) *Attorney, Agent, or Firm* — Kratz, Quintos & Hanson, LLP

(57) ABSTRACT

A main body portion is to be mounted to a housing by being inserted into the housing. An electrical wire insertion portion is provided in an end portion of the main body portion, defines an insertion opening into which a leading end portion of an electrical wire is to be inserted, and is configured to restrict movement of the electrical wire in a direction perpendicular to the direction of insertion of the electrical wire into the insertion opening. A conductive body connection portion is provided in the main body portion and is configured to be electrically connected to a conductive body of the electrical wire inserted into the insertion opening. A partner connection portion is provided in the main body portion and is configured to be electrically connected to a partner terminal.

5 Claims, 10 Drawing Sheets

(56) References Cited

U.S. PATENT DOCUMENTS

| | | | | |
|---|---|---|---|---|
| 6,336,824 | B1 * | 1/2002 | Sorig | H01R 4/4836 439/395 |
| 6,719,581 | B2 * | 4/2004 | Kikuchi | H01R 4/4881 439/441 |
| 7,004,781 | B2 * | 2/2006 | Walter | H01R 4/4836 439/268 |
| 7,083,463 | B2 * | 8/2006 | Steinkemper | H01R 4/4827 439/441 |
| 7,131,857 | B2 * | 11/2006 | Mueller | H01R 4/4845 439/441 |
| 7,287,999 | B2 * | 10/2007 | Holterhoff | H01R 4/4836 439/441 |
| 7,993,156 | B2 | 8/2011 | Holste | |
| 9,337,556 | B2 * | 5/2016 | Rask | F04D 13/0686 |
| 2010/0173531 | A1 | 7/2010 | Holste | |

* cited by examiner 12
21
22
23
24
24a
24b
24c
25
X1
X2

TERMINAL, AND ELECTRICAL CONNECTOR

CROSS-REFERENCE TO RELATED APPLICATION

This application claims priority to Japanese Patent Application No. 2017-143465. The entire disclosure of Japanese Patent Application No. 2017-143465 is hereby incorporated herein by reference.

BACKGROUND OF THE INVENTION

1. Field of the Invention

The present invention relates to a terminal for an electrical connector, which is for connection to a partner terminal in a state of being connected to an electrical wire and mounted to a housing of the electrical connector, and also relates to an electrical connector that includes this terminal.

2. Description of Related Art

JP 2009-531815A discloses a terminal for an electrical connector, which is used for connection to a partner terminal in a state of being connected to an electrical wire and mounted to a housing of the electrical connector, and also discloses an electrical connector that includes this terminal.

The electrical connector disclosed in JP 2009-531815A is configured as a plug-in connector (2) that includes an insulated body housing (3), an operation means (8), a spring force member (11), and a contact insertion member (14). In this plug-in connector (2), the spring force member (11) and the electrical contact insertion member (14) are provided as a terminal that is for connection to a contact pin (7), which is the partner terminal, in a state of being connected to an electrical conductor (6), which is an electrical wire, and mounted to the insulated body housing (3).

The spring force member (11) is placed inside and mounted to the insulated body housing (3), and is provided as a member for clamping the electrical conductor (6). The contact insertion member (14) is placed inside and mounted to the insulated body housing (3), and has a configuration including a contact surface for contact with the electrical conductor (6) and a connection member (18) for connection with the contact pin (7) inserted therein.

SUMMARY OF THE INVENTION

The terminal of the plug-in connector (2) in JP 2009-531815A has a configuration including the spring force member (11) and the contact insertion member (14), which are multiple members that have a complex spring structure and are for connection with the electrical conductor (6) by operating in coordination. For this reason, the terminal of the plug-in connector (2) in JP 2009-531815A has problems such as leading to an increase in the complexity and size of the terminal structure, and leading to an increase in the number of parts.

Also, with the terminal of the plug-in connector (2) in JP 2009-531815A, the spring force member (11) and the contact insertion member (14), which have a complex spring structure and are for connection with the electrical conductor (6) by operating in coordination, need to be placed inside and mounted to the insulated body housing (3) that serves as a housing. For this reason, the operation of mounting the terminal of the plug-in connector (2) in JP 2009-531815A to the housing is very troublesome.

Furthermore, when the terminal of the plug-in connector (2) in JP 2009-531815A is to be connected to the electrical conductor (6), which is an electrical wire, first, the spring force member (11) and the contact insertion member (14) that constitute the terminal need to be placed inside and mounted to the insulated body housing (3). Connection to the electrical wire is then performed in this state. For this reason, the operation of connecting the terminal of the plug-in connector (2) in JP 2009-531815A to the electrical wire is very troublesome.

In light of the above-described circumstances, an object of the present invention is to provide a terminal that can suppress an increase in the complexity and size of the terminal structure, also suppress an increase in the number of parts, and furthermore be easily connected to the electrical wire and easily mounted to the housing. A further object is to provide an electrical connector that includes this terminal.

(1) A terminal according to an aspect of the present invention for achieving the foregoing object is a terminal for an electrical connector, the terminal being used for connection to a partner terminal in a state of being connected to an electrical wire and mounted to a housing of the electrical connector. The terminal according to this aspect of the present invention includes: a main body portion configured to be mounted to the housing by being inserted into the housing; an electrical wire insertion portion that is provided in an end portion of the main body portion, defines an insertion opening into which a leading end portion of the electrical wire is to be inserted, and is configured to restrict movement of the electrical wire in a direction perpendicular to a direction of insertion of the electrical wire into the insertion opening; a conductive body connection portion that is provided in the main body portion and is configured to be electrically connected to a conductive body of the electrical wire inserted into the insertion opening; and a partner connection portion that is provided in the main body portion and is configured to be electrically connected to the partner terminal.

According to this, the terminal has a configuration including the main body portion that is to be inserted into the housing, and the main body portion is provided with the electrical wire insertion portion that receives insertion of the electrical wire, the conductive body connection portion that is to be connected to the conductive body of the inserted electrical wire, and the partner connection portion that is to be connected to the partner terminal. For this reason, the above configuration enables realizing, with a simple structure, the terminal for the electrical connector, which is used for connection to the partner terminal in a state of being connected to the electrical wire and mounted to the housing of the electrical connector. Therefore, according to the above configuration, it is possible to suppress an increase in the complexity and size of the terminal structure. Also, the terminal can be configured by a single component that includes the main body portion, which is provided with the electrical wire insertion portion, the conductive body connection portion, and the partner connection portion. Therefore, according to the terminal having the above configuration, it is possible to also suppress an increase in the number of parts.

Also, according to the above configuration, the terminal can be mounted to the housing by merely inserting the main body portion, which is provided with the electrical wire insertion portion, the conductive body connection portion, and the partner connection portion, into the housing. Therefore, according to the above configuration, the terminal can be easily mounted to the housing. Furthermore, according to the terminal having the above configuration, the operation of connecting the terminal and the electrical wire can be easily performed by inserting the leading end portion of the electrical wire into the insertion opening of the electrical wire insertion portion in the end portion of the main body portion of the terminal, and connecting the conductive body of the electrical wire to the conductive body connection portion provided in the main body portion. Also, movement of the electrical wire, which is connected to the terminal, in a direction perpendicular to the direction of insertion of the electrical wire into the insertion opening is restricted in the electrical wire insertion portion in the end portion of the main body portion of the terminal. For this reason, it is possible to suppress instability of the connection state between the terminal and the electrical wire caused by the electrical wire connected to the terminal becoming excessively displaced from the terminal, and it is possible to maintain a stable connection state between the terminal and the electrical wire.

As described above, according to the above configuration, it is possible to provide the terminal that can suppress an increase in the complexity and size of the terminal structure, also suppress an increase in the number of parts, and furthermore be easily connected to the electrical wire and easily mounted to the housing.

(2) A configuration is possible in which the insertion opening is provided as a through-hole in the end portion of the main body portion.

According to the above configuration, the insertion opening, which receives insertion of the leading end portion of the electrical wire, is provided as a through-hole in the end portion of the main body portion of the terminal. For this reason, when the operation of connecting the electrical wire to the terminal is performed, it is sufficient to insert the leading end portion of the electrical wire into the through-hole in the end portion of the terminal. For this reason, the operation of connecting the terminal and the electrical wire can be performed more easily. Also, the insertion opening for receiving insertion of the electrical wire is provided as a through-hole, thus making it possible to realize a structure for the insertion opening that enables easily guiding the leading end portion of the electrical wire when the leading end portion of the electrical wire is inserted therein. Accordingly, it is possible to realize the terminal that achieves easily guiding the leading end portion of the electrical wire, and easily inserting and connecting the electrical wire.

(3) A configuration is possible in which the conductive body connection portion includes an electrical contact portion that is provided inside the main body portion and is configured to come into contact with and be electrically connected to the conductive body, and a pair of contact spring portions that are provided as plate spring-shaped portions extending in a cantilevered manner inward in the main body portion from a pair of opposing wall portions of the main body portion, and are configured to sandwich, from two sides, the conductive body of the electrical wire inserted into the insertion opening, and the electrical contact portion is provided at a leading end side of each of the contact spring portions that extend in a cantilevered manner.

According to the above configuration, the conductive body connection portion has a configuration including the pair of contact spring portions that extend in a cantilevered manner and are provided with the electrical contact portions on the respective leading end sides. Also, the conductive body in the leading end portion of the electrical wire, which has been inserted into the insertion opening in the end portion of the main body portion of the terminal, is sandwiched by the pair of contact spring portions inside the main body portion, and comes into contact with the electrical contact portions on the leading end sides of the pair of contact spring portions, thus being electrically connected to the terminal. For this reason, the electrical wire inserted into the insertion opening of the main body portion of the terminal can be easily connected to the conductive body connection portion inside the main body portion, and the electrical wire and the conductive body connection portion can be connected in a more secure and stable state.

(4) A configuration is possible in which the terminal further includes a positioning portion that is provided in the main body portion and is configured to abut against and position a leading end portion of the conductive body of the electrical wire inserted into the insertion opening.

According to the above configuration, it is possible to easily position the electrical wire relative to the terminal by merely inserting the electrical wire into the insertion opening in the end portion of the main body portion of the terminal, and inserting the electrical wire into the terminal to a position at which the leading end portion of the conductive body of the electrical wire abuts against the positioning portion provided in the main body portion. For this reason, according to the above configuration, it is possible to realize a structure for easily performing positioning by inserting the electrical wire to an appropriate position in the terminal.

(5) An electrical connector according to an aspect of the present invention for achieving the foregoing object includes: the terminal according to any of the above-described aspects of the present invention; and a housing that has an insertion hole into which the main body portion of the terminal is to be inserted, and is configured to hold the terminal inserted into the insertion hole.

According to this configuration, it is possible to achieve effects similar to those of the above-described terminal according to an aspect of the present invention. In other words, according to this configuration, it is possible to provide the electrical connector that includes the terminal that can suppress an increase in the complexity and size of the terminal structure, also suppress an increase in the number of parts, and furthermore be easily connected to the electrical wire and easily mounted to the housing.

(6) A configuration is possible in which the main body portion of the terminal is provided with an engaging portion that has a plate spring-shaped portion extending in a cantilevered manner and that is configured to engage with the housing from a position inward of the insertion hole of the housing, and the housing is provided with an engaged portion configured such that the engaging portion is fitted therein and engaged therewith in a loose-fit state.

According to this configuration, the engaging portion, which has a plate spring-shaped portion in the main body portion of the terminal, engages with the housing from a position inward of the insertion hole of the housing. For this reason, when the terminal is inserted into and mounted to the housing, the terminal can be easily held in the housing in a state of being prevented from coming out of the housing. Also, the engaged portion of the housing is configured such that the engaging portion of the terminal is fitted therein and engaged therewith in a loose-fit state. Accordingly, when the electrical connector is connected to the partner connector, and the terminal in the electrical connector is connected to the partner terminal in the partner connector, the terminal can be displaced inside the housing in accordance with the positional relationship with the partner terminal. For this reason, when connecting the terminal and the partner terminal, the terminal can be displaced in the housing so as to guide the partner terminal according to the positional relationship with the partner terminal, and the terminal and the partner terminal can be easily connected. Accordingly, even if an amount of shift within the tolerance arises in the positional relationship between the terminal and the partner terminal, it is possible to easily absorb that amount of shift and easily connect the terminal and the partner terminal.

Note that the above and other objects, features, and advantages of this invention will become apparent by reading the following description with the attached drawings.

DETAILED DESCRIPTION OF THE INVENTION

Hereinafter, an embodiment for carrying out the present invention will be described with reference to the drawings. Note that the present invention is broadly applicable to a terminal for an electrical connector, which is used for connection to a partner terminal in a state of being connected to an electrical wire and mounted to a housing of the electrical connector, and is also applicable to an electrical connector that includes this terminal.

Overview of Electrical Connector

Figure 1:
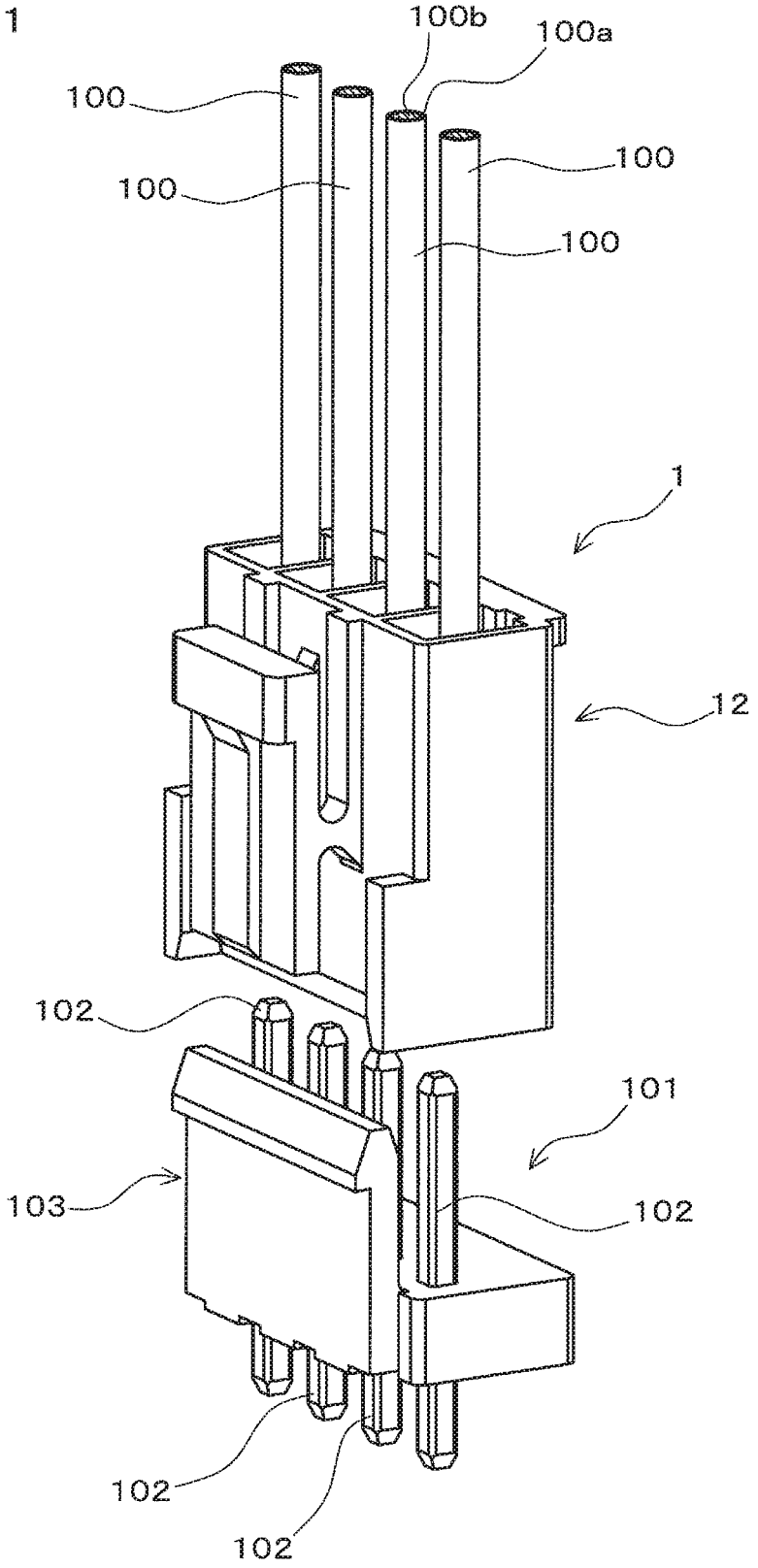
FIG. 1 is a perspective view of an electrical connector according to an embodiment of the present invention, and also shows electrical wires and a partner connector.
Figure 2:
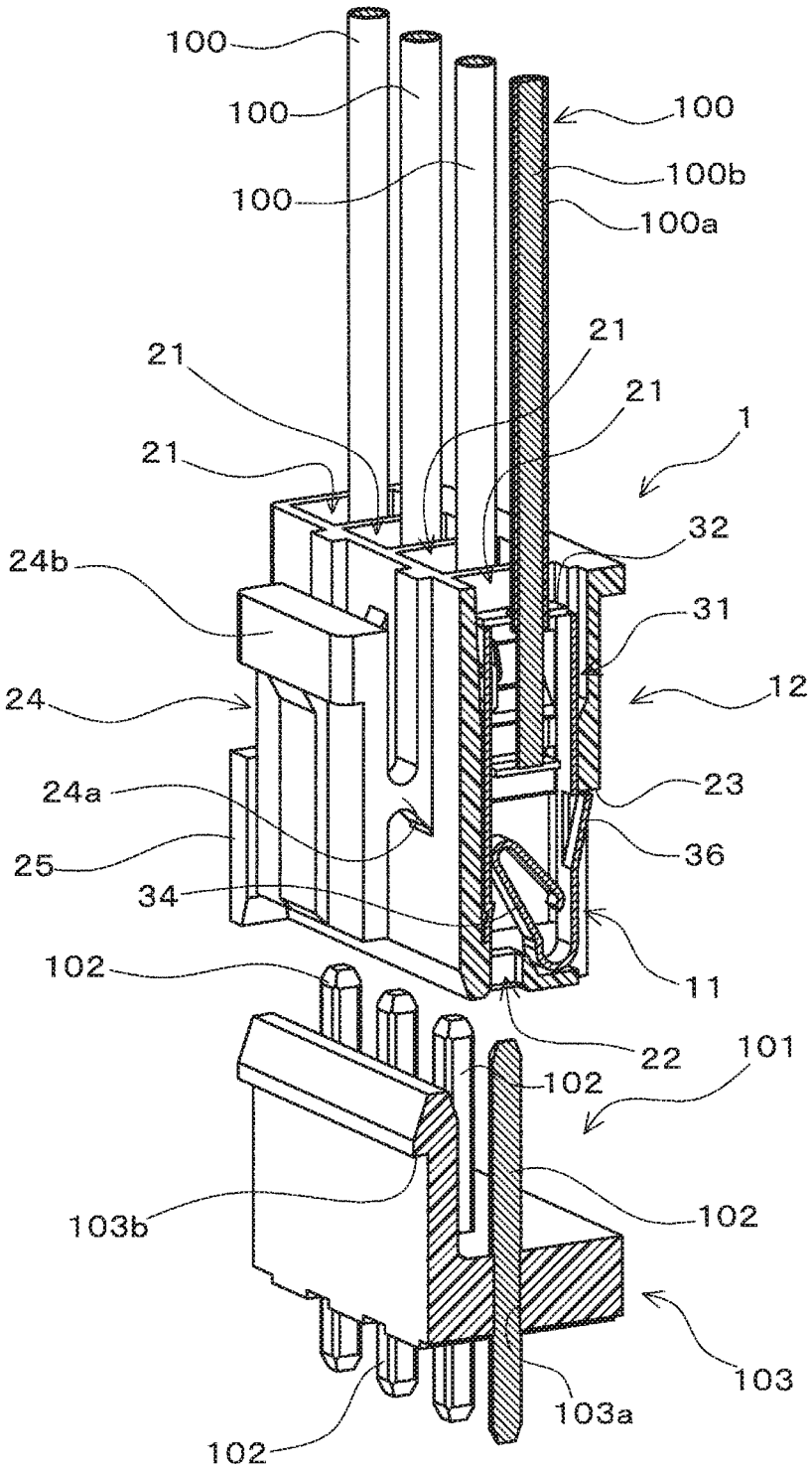
FIG. 2 is a perspective view of a cross-section of the electrical connector, and also shows the electrical wires and the partner connector.
Figure 3:
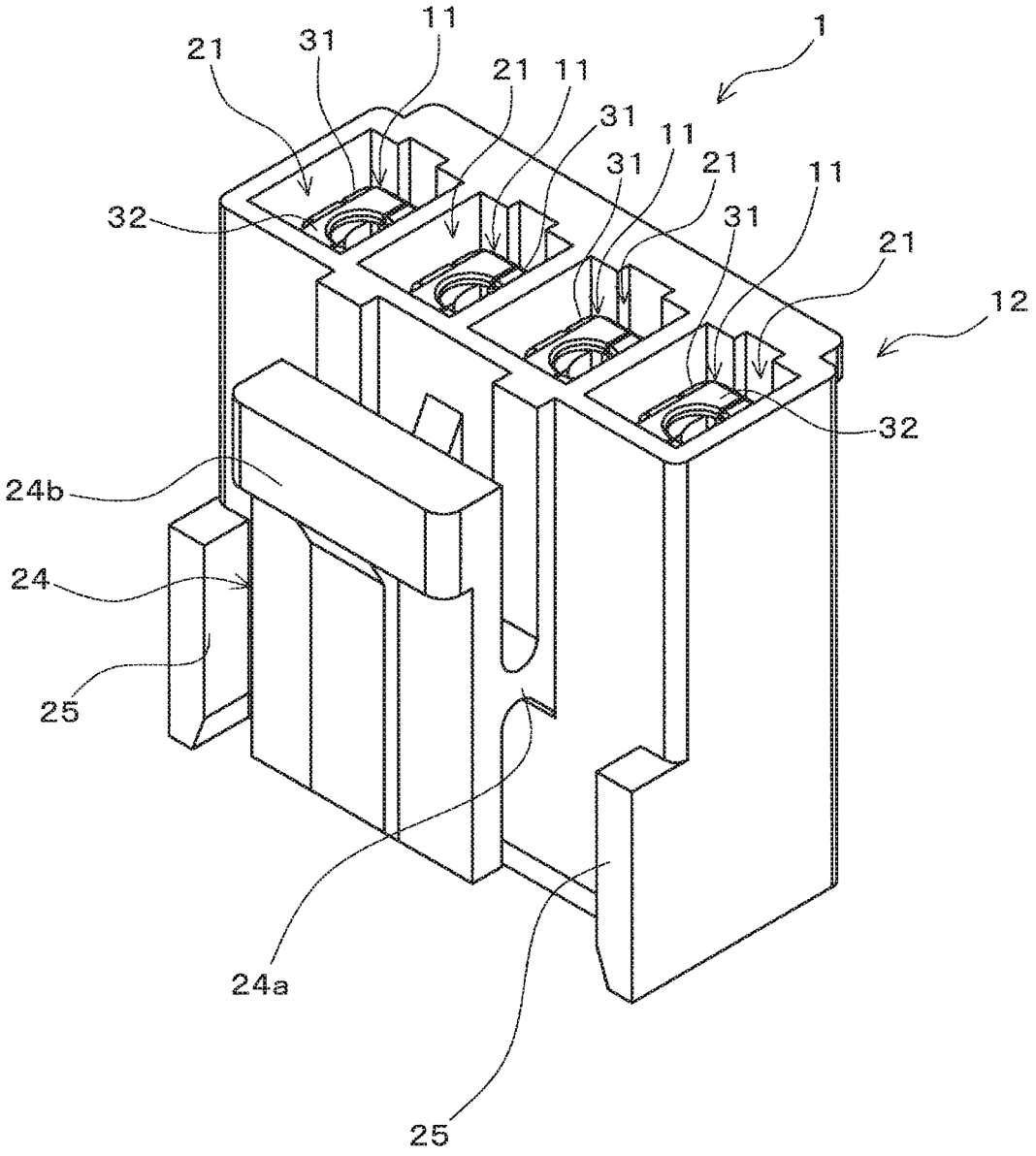
FIG. 3 is a perspective view of the electrical connector.

FIG. 1 is a perspective view of an electrical connector 1 according to an embodiment of the present invention, and also shows electrical wires 100 and a partner connector 101. FIG. 2 is a perspective view of a cross-section of the electrical connector 1, and also shows the electrical wires 100 and the partner connector 101. FIG. 3 is a perspective view of the electrical connector 1. Note that only portions of the electrical wires 100 are shown in FIGS. 1 and 2.

The electrical connector 1 shown in FIGS. 1 to 3 is provided as a connector for electrically connecting the electrical wires 100 to the partner connector 101. The electrical connector 1 has a configuration including multiple terminals 11 and a housing 12. Note that the terminals 11 each constitute the terminal according to an embodiment of the present invention.

The terminals 11 of the electrical connector 1 are configured to be mechanically and electrically connected to respective electrical wires 100, and to also be mechanically and electrically connected to partner terminals 102 of the partner connector 101. The terminals 11 are formed using a metal material that has electrical conductive properties. The terminals 11 are inserted into and mounted to the housing 12 after being connected to the electrical wires 100, for example. Alternatively, the terminals 11 are connected to the electrical wires 100 after being inserted into and mounted to the housing 12. FIG. 3 shows an example of the electrical connector 1 in the state where the terminals 11 are mounted to the housing 12 and have not been connected to electrical wires 100. Note that the configuration of the terminals 11 will be described in detail later.

The housing 12 of the electrical connector 1 is formed using a resin material that has insulating properties, and is configured to hold multiple terminals 11. Also, the housing 12 is provided as a constituent element that is to be mechanically connected to the partner connector 101. Due to the housing 12 being mechanically connected to the partner connector 101, the terminals 11 are electrically and mechanically connected to the respective partner terminals 102 of the partner connector 101. Note that the configuration of the housing 12 will be described in detail later.

The partner connector 101 that is to be connected to electrical connector 1 is configured as a connector for connection to a substrate (not shown) provided with a conductive circuit pattern on at least either one of the front and back surfaces, for example. The partner connector 101 has a configuration including multiple partner terminals 102 and a terminal block 103.

The partner terminals 102 are configured so as to be mechanically and electrically connected to respective terminals 11 of the electrical connector 1, and so as to also be mechanically and electrically connected to a substrate that is not shown. The partner terminals 102 are formed using a metal material that has electrical conductive properties, and are configured as pin-type terminals, for example. When connecting the partner connector 101 to the substrate, the partner terminals 102 are connected to the substrate by soldering.

The terminal block 103 of the partner connector 101 is formed using an resin material that has insulating properties, and is configured to hold multiple partner terminals 102. The terminal block 103 is provided with multiple press-fitting holes 103*a* into which the partner terminals 102 are to be press-fitted (see FIG. 2). The partner terminals 102 are held in the terminal block 103 by being press-fitted into the press-fitting holes 103*a*. The terminal block 103 is also provided with a housing lock portion 103*b* that engages with and locks the housing 12 of the electrical connector 1 when the electrical connector 1 is connected thereto. When the electrical connector 1 and the partner connector 101 are connected, the housing 12 engages with the housing lock portion 103*b* of the terminal block 103, and thus the housing 12 and the terminal block 103 are mechanically locked to each other, and removal of the electrical connector 1 from the partner connector 101 is prevented.

Note that although the partner connector 101 for connection to a substrate is illustrated as an example of the partner connector for connection to the electrical connector 1 in the present embodiment, there is no limitation to this. The partner connector for connection to the electrical connector 1 may be a partner connector that is for connection to electrical wires other than the electrical wires 100.

Housing

Figures 4A, 4B, 4C:
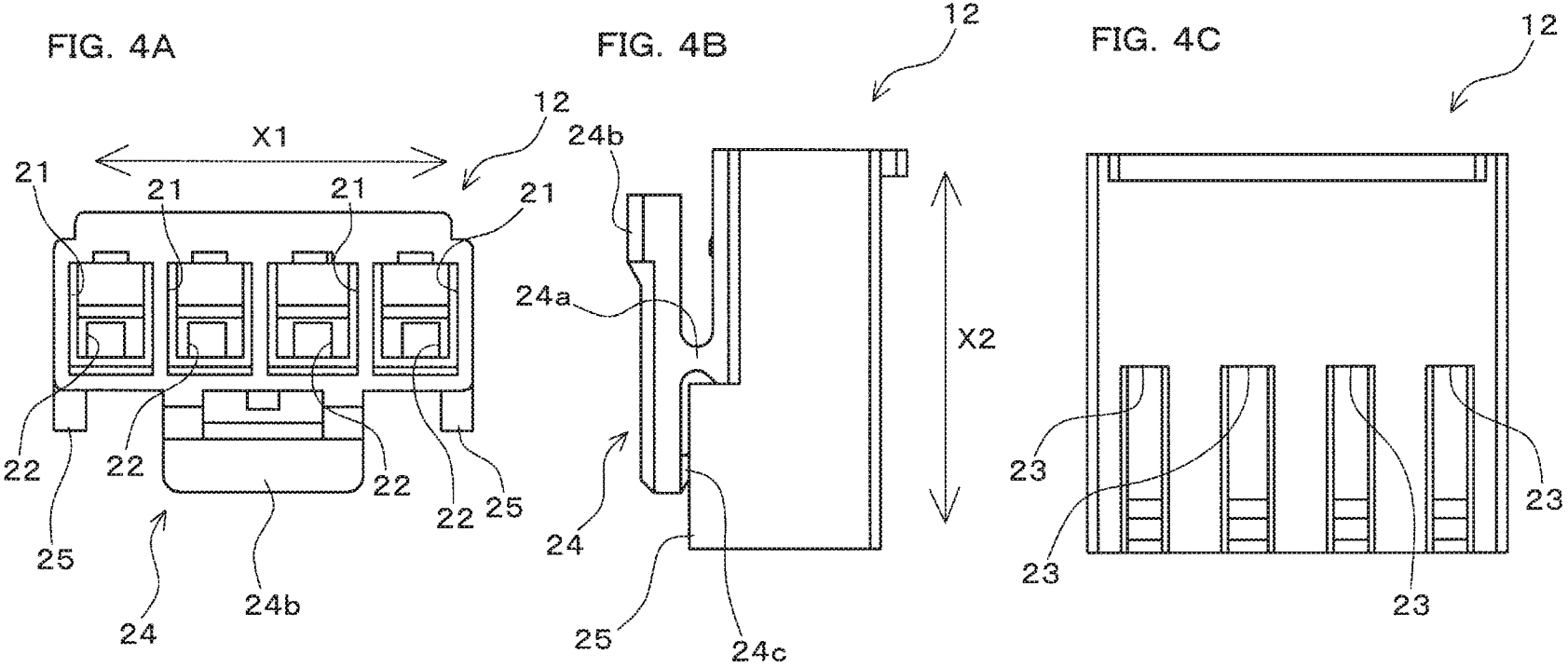
FIGS. 4A to 4C are respectively a plan view, a side view, and a rear view of a housing of the electrical connector.

FIGS. 4A to 4C are respectively a plan view (top view), a side view, and a rear view of the housing 12 of the electrical connector 1. The housing 12 shown in FIGS. 1 to 4C is formed using a resin material that has insulating properties, and is provided as a member that has a case-shaped portion for holding multiple terminals 11. The housing 12 has a configuration including multiple insertion holes 21, multiple terminal connection holes 22, multiple engaged portions 23, a lock arm 24, a pair of connection guides 25, and the like.

The insertion holes 21 of the housing 12 are provided as holes for insertion of respective terminals 11. Main body portions 31 of the terminals 11 are inserted into the insertion holes 21. The housing 12 is configured to hold the terminals 11 in a state of being inserted into the insertion holes 21. Also, the insertion holes 21 are formed in an end portion of the housing 12 on the side opposite to the end portion on the side for connection to the partner connector 101. For this reason, the main body portions 31 of the terminals 11 are inserted into the insertion holes 21 of the housing 12 from the side opposite to the side that is for connection to the partner connector 101. Also, the insertion holes 21 are provided side-by-side along the width direction of the housing 12. Note that the width direction of the housing 12 is indicated by a double-headed arrow X1 in FIG. 4A. Also, the width direction of the housing 12 is the width direction of the electrical connector 1.

The terminal connection holes 22 of the housing 12 are provided as holes for connection of the terminals 11 and the partner terminals 102 when connecting the electrical connector 1 and the partner connector 101. For this reason, the terminal connection holes 22 are provided as holes for insertion of the partner terminals 102 for when the terminals 11 and the partner terminals 102 are to be connected, and the terminal connection holes 22 are in communication with the insertion holes 21 inside the housing 12. Also, the terminal connection holes 22 are formed in the end portion of the housing 12 on the side for connection to the partner connector 101.

The engaged portions 23 of the housing 12 are provided as portions for engagement with the terminals 11 that have been inserted into the insertion holes 21 of the housing 12. Also, the engaged portions 23 are configured such that later-described engaging portions 36 of the terminals 11 are fitted therein and engaged in a loose-fit state. Note that in the present embodiment, the engaged portions 23 are provided on the back face side of the housing 12, and are provided as edge portions of partial cutouts provided in a wall portion of the housing 12. Also, the engaged portions 23 are provided as edge portions of open regions formed at positions corresponding to the insertion holes 21 and facing outward from the housing 12 on the back face side of the housing 12.

The lock arm 24 of the housing 12 is provided as a portion for engaging with the housing lock portion 103*b* of the terminal block 103 and mechanically locking the housing 12 and the terminal block 103 to each other when the electrical connector 1 and the partner connector 101 are connected. Due to the lock arm 24 and the housing lock portion 103*b* engaging with each other, and the housing 12 and the terminal block 103 being locked to each other, removal of the electrical connector 1 from the partner connector 101 is prevented.

The lock arm 24 is provided in a central portion in the width direction of the housing 12 on the front face side of the housing 12. The lock arm 24 has a configuration including a fulcrum portion 24*a*, an operation portion 24*b*, and an engaging protrusion portion 24*c*. The fulcrum portion 24*a* is integrated with the main body portion of the housing 12. The lock arm 24 has a see-saw structure of being integrally supported by the fulcrum portion 24*a* in the housing 12. The operation portion 24*b* is provided as a portion that is supported to the fulcrum portion 24*a* in a cantilevered manner. Also, the operation portion 24*b* is provided as a portion that is pressed by a worker when disengaging the lock arm 24 and the housing lock portion 103*a* of the terminal block 103. The engaging protrusion portion 24*c* is formed as a protrusion portion that rises with the shape of a projection on the lock arm 24, and is provided as a portion that engages with the housing lock portion 103*a* of the terminal block 103. When connecting the electrical connector 1 and the partner connector 101, the lock arm 24 temporarily undergoes elastic deformation when the engaging protrusion portion 24*c* and the housing lock portion 103*a* come into contact with each other. After this elastic deformation, the engaging protrusion portion 24*e* rides over the housing lock portion 103*a*, and then the lock arm 24 undergoes elastic recovery, and the engaging protrusion portion 24*c* and the housing lock portion 103*a* engage with each other.

The pair of connection guides 25 of the housing 12 are provided as portions that guide the direction of connection of the housing 12 to the terminal block 103 when the electrical connector 1 is connected to the partner connector 101. The pair of connection guides 25 are provided as portions that rise with a step-like shape in edge portions on respective sides in the width direction of the housing 12. Also, the pair of connection guides 25 are provided as portions that extend in the up-down direction of the housing 12 while rising with a step-like shape in edge portions on respective sides in the width direction of the housing 12. Note that the up-down direction of the housing 12 is indicated by a double-headed arrow X2 in FIG. 4B. Also, the up-down direction of the housing 12 is the up-down direction of the electrical connector 1. When the electrical connector 1 is connected to the partner connector 101, the pair of connection guides 25 slide along the edge portions on the two sides in the width direction of the terminal block 103. The direction of connection of the housing 12 to the terminal block 103 is guided in this way.

Terminal

Figure 5A:
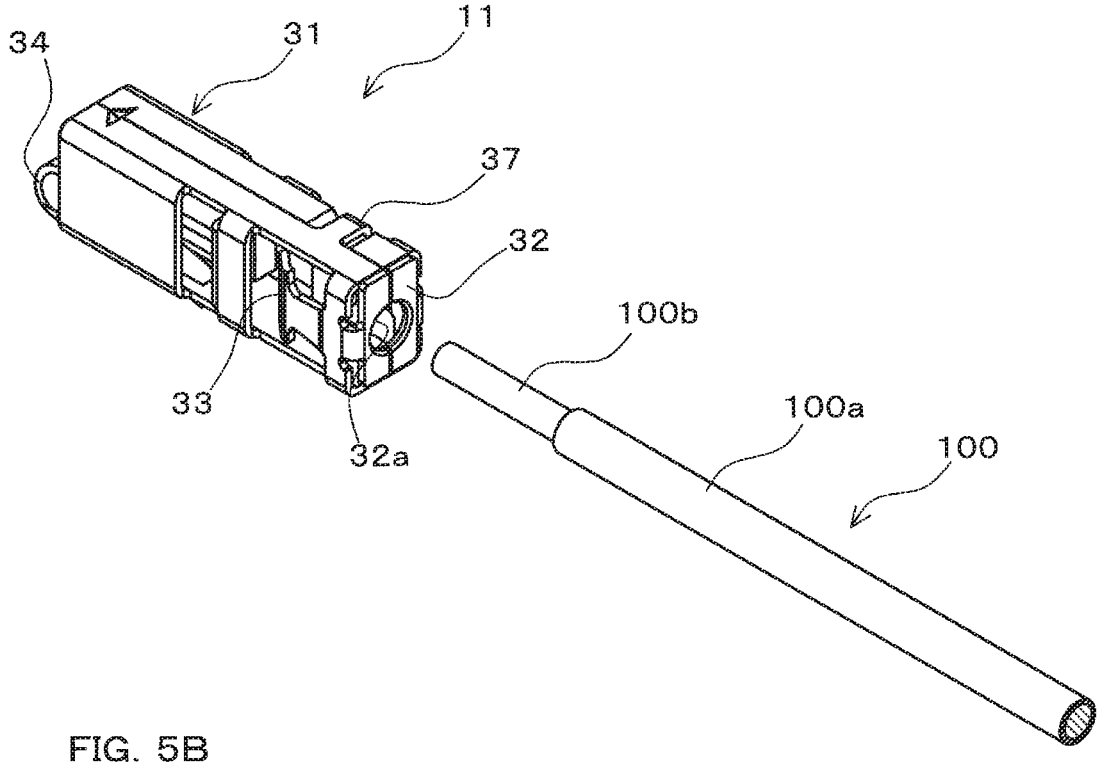
FIGS. 5A and 5B are perspective views of a terminal according to an embodiment of the present invention, and also show an electrical wire.
Figure 5B:
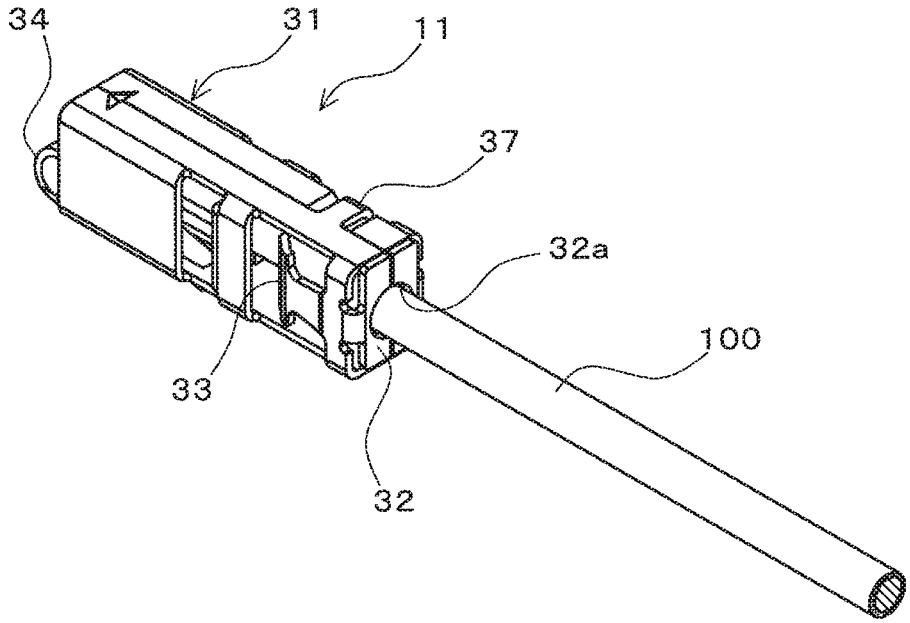
Figure 6A:
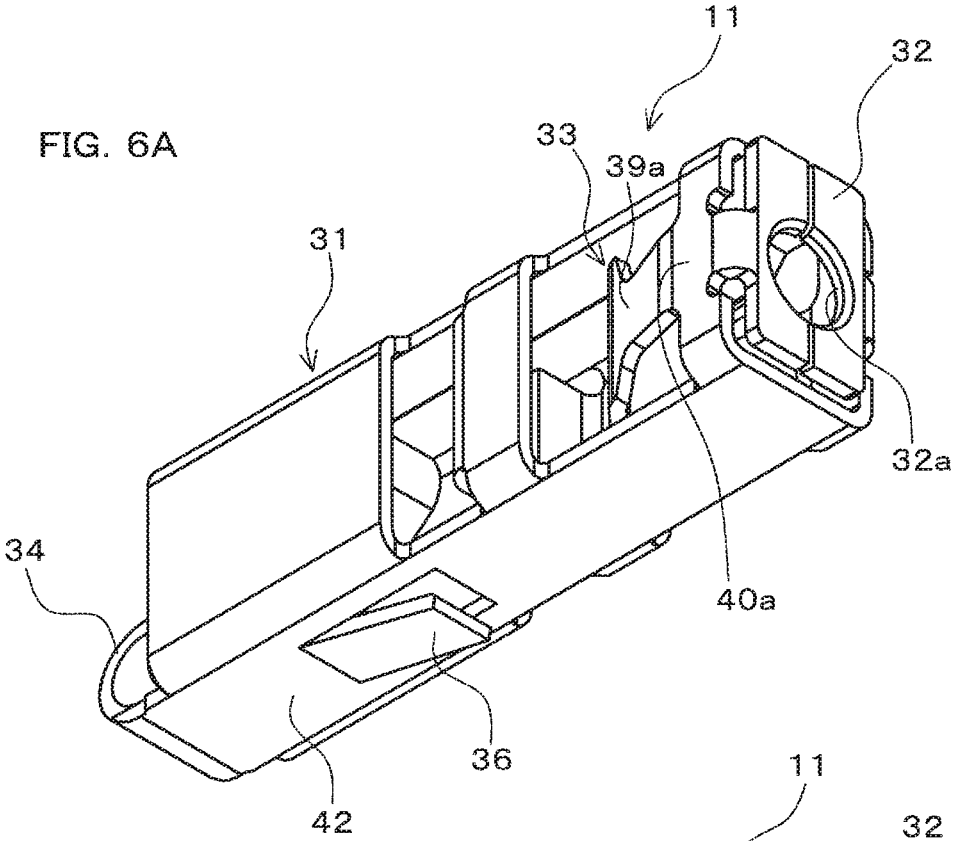
FIGS. 6A and 6B are perspective views of the terminal.
Figure 6B:
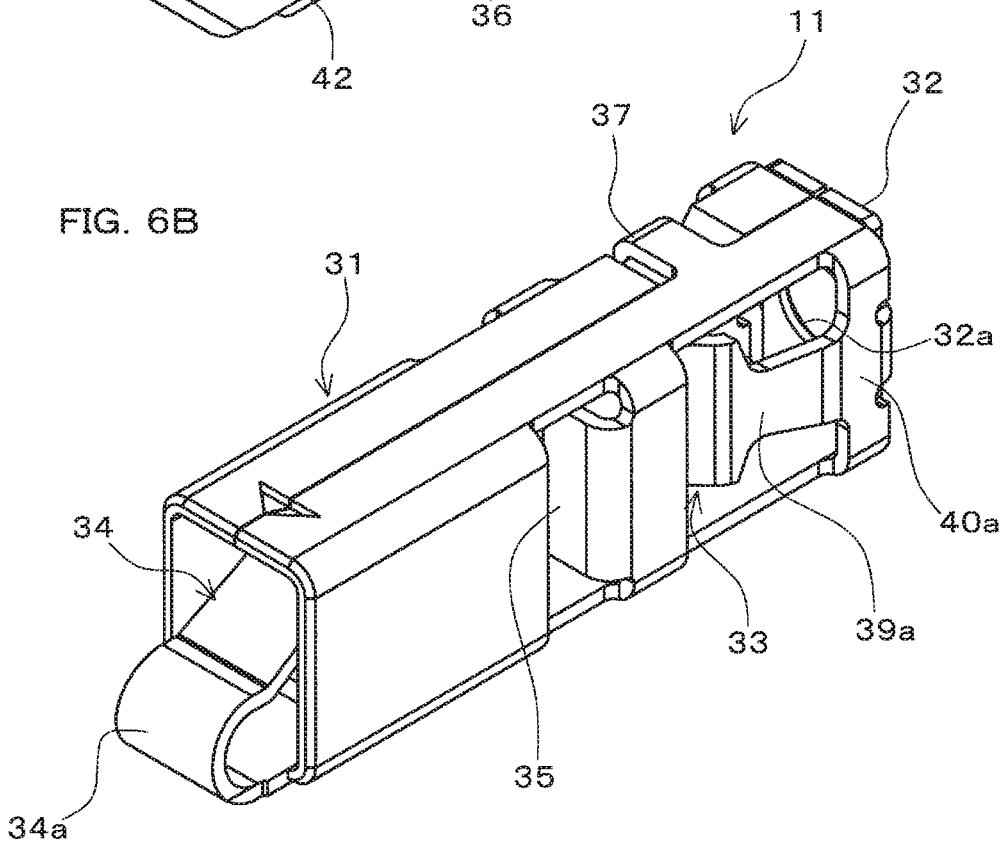
Figure 7A:
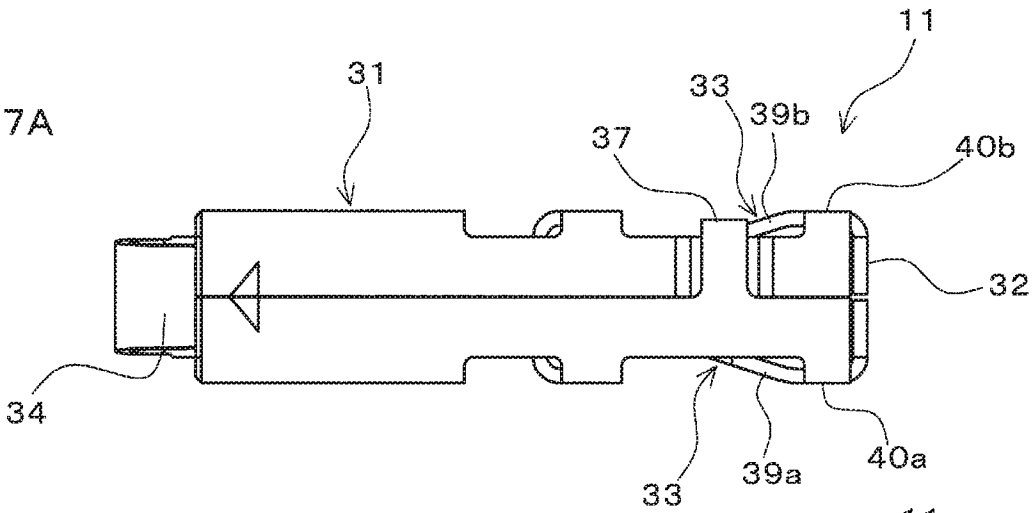
FIGS. 7A to 7C are respectively a plan view, a front view, and a side view of the terminal.
Figure 7B:
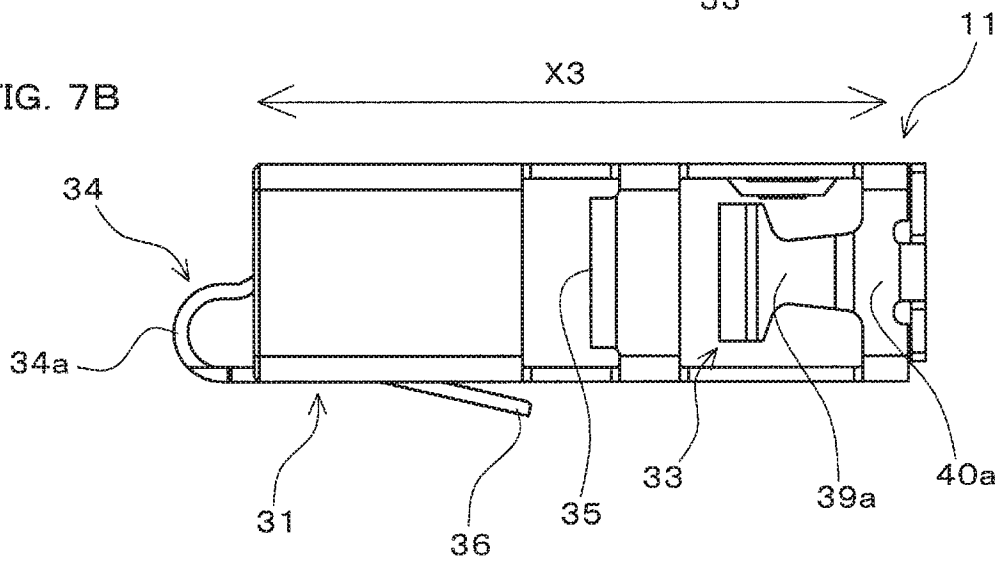
Figure 7C:
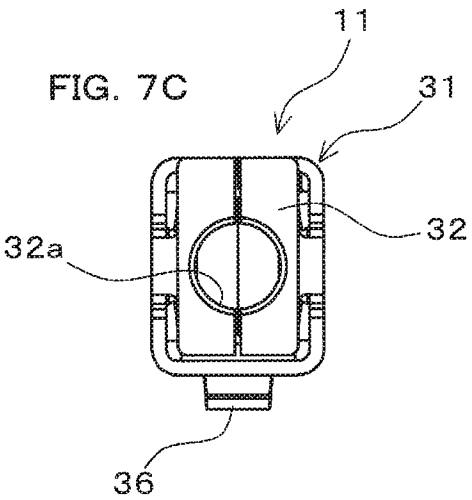

Next, the terminal 11 of the electrical connector 1 will be described in further detail. FIGS. 5A and 5B are perspective views of the terminal 11, and show an electrical wire 100 as well. Note that only a portion of the electrical wire 100 is shown in FIGS. 5A and 5B. Also, FIG. 5A is a perspective view of the state where the electrical wire 100 is not connected to the terminal 11, and FIG. 5B is a perspective view of the state where the electrical wire 100 is connected to the terminal 11. FIGS. 6A and 6B are perspective views of the terminal 11. Note that FIGS. 6A and 6B are perspective views of the terminal 11 from different directions. FIGS. 7A, 7B, and 7C are respectively a plan view, a front view, and a side view of the terminal. Note that the front direction of the terminal 11 in FIGS. 7A to 7C is defined as a direction that is independent from the front direction of the electrical connector 1 in FIGS. 4A to 4C. The terminal 11 shown in FIGS. 2, 3, and 5A to 7C constitutes the terminal according to an embodiment of the present invention, and a plurality of such terminals are provided in the electrical connector 1.

The terminal 11 is configured as a terminal for the electrical connector 1, which is used for connection to the partner terminal 102 in a state of being connected to the electrical wire 100 and mounted to the housing 12 of the electrical connector 1. The terminal 11 has a configuration including a main body portion 31, an electrical wire insertion portion 32, a conductive body connection portion 33, a partner connection portion 34, a positioning portion 35, an engaging portion 36, a hook portion 37, and the like. The terminal 11 is formed by, for example, bending a single metal plate that has been appropriately subjected to punch processing, cutting processing, and the like.

As shown in FIGS. 2, 3, and 5A to 7C, the main body portion 31 has an approximately rectangular tube-shaped basic outer form, and is configured to be mounted to the housing 12 by being inserted into an insertion hole 21 of the housing 12. The outer shape of a cross-section of the approximately rectangular tube-shaped basic form portion of the main body portion 31 substantially corresponds to the cross-sectional shape of the insertion hole 21.

As shown in FIGS. 5A to 7C, the electrical wire insertion portion 32 is provided in an end portion of the main body portion 31. More specifically, the electrical wire insertion portion 32 is provided in one end portion in the longitudinal direction of the main body portion 31. Note that the longitudinal direction of the main body portion 31 is indicated by a double-headed arrow X3 in FIG. 7B. The longitudinal direction of the main body portion 31 is the longitudinal direction of the terminal 11. Also, the electrical wire insertion portion 32 defines an insertion opening 32*a* for receiving insertion of the leading end portion of the electrical wire 100. The insertion opening 32*a* is provided as a circular through-hole in the end portion of the main body portion 31. Also, the electrical wire insertion portion 32 is configured to restrict movement of the electrical wire 100 in a direction perpendicular to the direction of insertion of the electrical wire 100 into the insertion opening 32*a*. In other words, when the electrical wire 100 has been inserted into the insertion opening 32*a*, movement in a direction perpendicular to the direction of insertion of the electrical wire 100 into the insertion opening 32*a* is restricted by the circular edge portion of the insertion opening 32*a*.

The diameter dimension of the insertion opening 32*a*, which is provided as a circular through-hole in the end portion of the main body portion 31, is set to a dimension that corresponds to the diameter dimension of the electrical wire 100. More specifically, the diameter dimension of the insertion opening 32*a* is set to a dimension that is slightly larger than the diameter dimension of the electrical wire 100, for example. Also, if the electrical wire 100 is configured as a thick wire that has a relatively large diameter dimension for example, the electrical wire insertion portion 32 is provided with an insertion opening 32*a* having a hole diameter that corresponds to the diameter dimension of the thick electrical wire 100. However, if the electrical wire 100 is configured as a thin wire that has a relatively small diameter dimension for example, the electrical wire insertion portion 32 is provided with an insertion opening 32*a* having a hole diameter that corresponds to the diameter dimension of the thin electrical wire 100. In this way, the electrical wire insertion portion 32 is provided with an insertion opening 32*a* having a diameter that corresponds to the diameter dimension of the electrical wire 100, thus appropriately restricting movement of the electrical wire in a direction perpendicular to the direction of insertion of the electrical wire 100 into the insertion opening 32*a*.

Note that in the terminal 11, as described above, the electrical wire insertion portion 32 is provided with an insertion opening 32*a* having a diameter that corresponds to the diameter dimension of the electrical wire 100, thus appropriately restricting movement of the electrical wire 100 in a direction perpendicular to the direction of insertion of the electrical wire 100 into the insertion opening 32*a*. Accordingly, in the terminal 11, when the electrical wire 100 is inserted into the main body portion 31 through the insertion opening 32*a*, the leading end portion of the electrical wire 100 is inserted into the main body portion 31 with a stable orientation and appropriately guided to the position of the later-described conductive body connection portion 33. For this reason, it is possible to suppress the case where the leading end portion of the electrical wire 100 inserted through the insertion opening 32*a* becomes caught at a portion other than the conductive body connection portion 33 inside the main body portion 31. It is also possible to suppress the case where the leading end portion of the electrical wire 100 inserted through the insertion opening 32*a* comes into contact with the conductive body connection portion 33 from an inappropriate direction and damages the conductive body connection portion 33.

Figure 8:
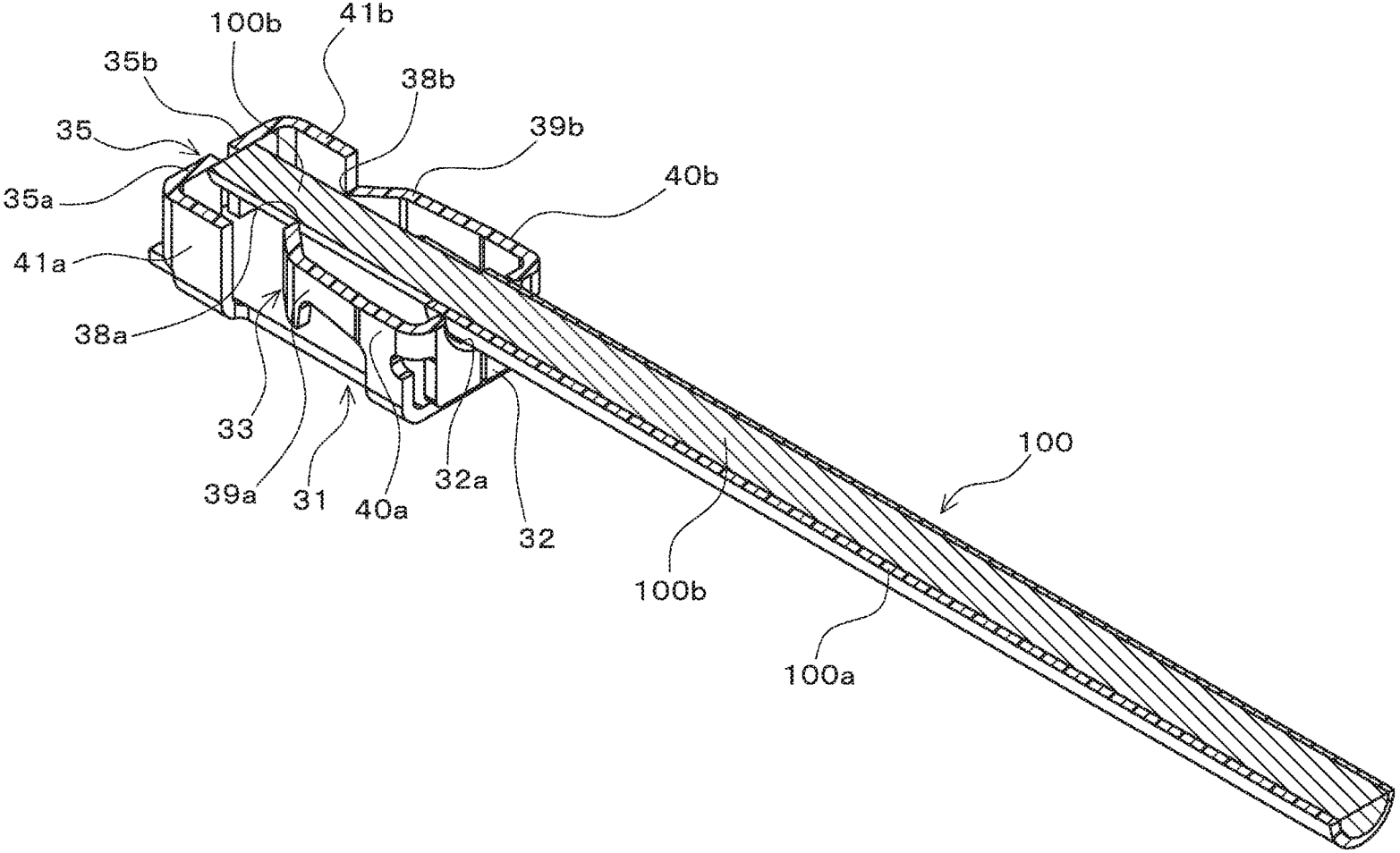
FIG. 8 is a perspective view of a cross-section of part of the terminal, and also shows an electrical wire.

FIG. 8 is a perspective view of a cross-section of part of the terminal 11, and also shows the electrical wire 100. Note that the partial cross-section of the terminal 11 in FIG. 8 is a cross-section of a portion on one end portion side in the longitudinal direction of the main body portion 31, and is a portion that includes the electrical wire insertion portion 32, the conductive body connection portion 33, and the positioning portion 35. Also, only a portion of the electrical wire 100 is shown in FIG. 8.

The conductive body connection portion 33 shown in FIGS. 5A to 8 is provided in the main body portion 31, and is configured as a portion for electrically connection with a conductive body 100*b* in the leading end portion of the electrical wire 100 inserted into the insertion opening 32*a*. Note that the electrical wire 100 has a configuration including the conductive body 100*b*, which is constituted as a metal material having electrical conductive properties, and a covering portion 100*a*, which surrounds the conductive body 100*b* and is constituted by a rubber material or the like having insulating properties. The conductive body 100*b* of the electrical wire 100 is configured as a single metal member, for example. Also, in the leading end portion of the electrical wire 100, a portion of the covering portion 100*a* is removed so as to expose the conductive body 100*b* to the outside (see FIGS. 5A and 8). Also, the conductive body connection portion 33, which is for connection to the conductive body 100*b* in the leading end portion of the electrical wire 100, has a configuration including a pair of electrical contact portions 38*a* and 38*b* and a pair of contact spring portions 39*a* and 39*b*.

The pair of electrical contact portions 38*a* and 38*b* are provided as portions provided inside the main body portion 31 for contact and electrical connection with the conductive body 100*b* in the leading end portion of the electrical wire 100. Also, the pair of electrical contact portions 38*a* and 38*b* are arranged inside the main body portion 31 so as to come into contact, from two sides, with the conductive body 100*b* in the leading end portion of the electrical wire 100 inserted through the insertion opening 32*a* of the main body portion 31.

The pair of contact spring portions 39*a* and 39*b* are provided as plate spring-shaped portions that extend in a cantilevered manner inward in the main body portion 31 from a pair of opposing wall portions 40*a* and 40*b* of the main body portion 31. Also, the pair of contact spring portions 39*a* and 39*b* extend in a cantilevered manner inward in the main body portion 31 from the pair of wall portions 40*a* and 40*b* in a direction that is inclined relative to the longitudinal direction of the main body portion 31, so as to approach each other. Furthermore, the pair of contact spring portions 39*a* and 39*b* extend in a cantilevered manner from the pair of wall portions 40*a* and 40*b* so as to approach each other while extending along the direction of insertion of the electrical wire 100 into the insertion opening 32*a*. The pair of contact spring portions 39*a* and 39*b* are configured so as to sandwich, from two sides, the conductive body 100*b* of the electrical wire 100 inserted through the insertion opening 32*a*. Also, the electrical contact portions 38*a* and 38*b* are provided on the leading end sides of the pair of contact spring portions 39*a* and 39*b* that extend in a cantilevered manner. More specifically, the electrical contact portion 38*a* is integrated with the contact spring portion 39*a* on the leading end side of the contact spring portion 39*a* that extends in a cantilevered manner. The electrical contact portion 38*b* is integrated with the contact spring portion 39*b* on the leading end side of the contact spring portion 39*b* that extends in a cantilevered manner.

Figure 9:
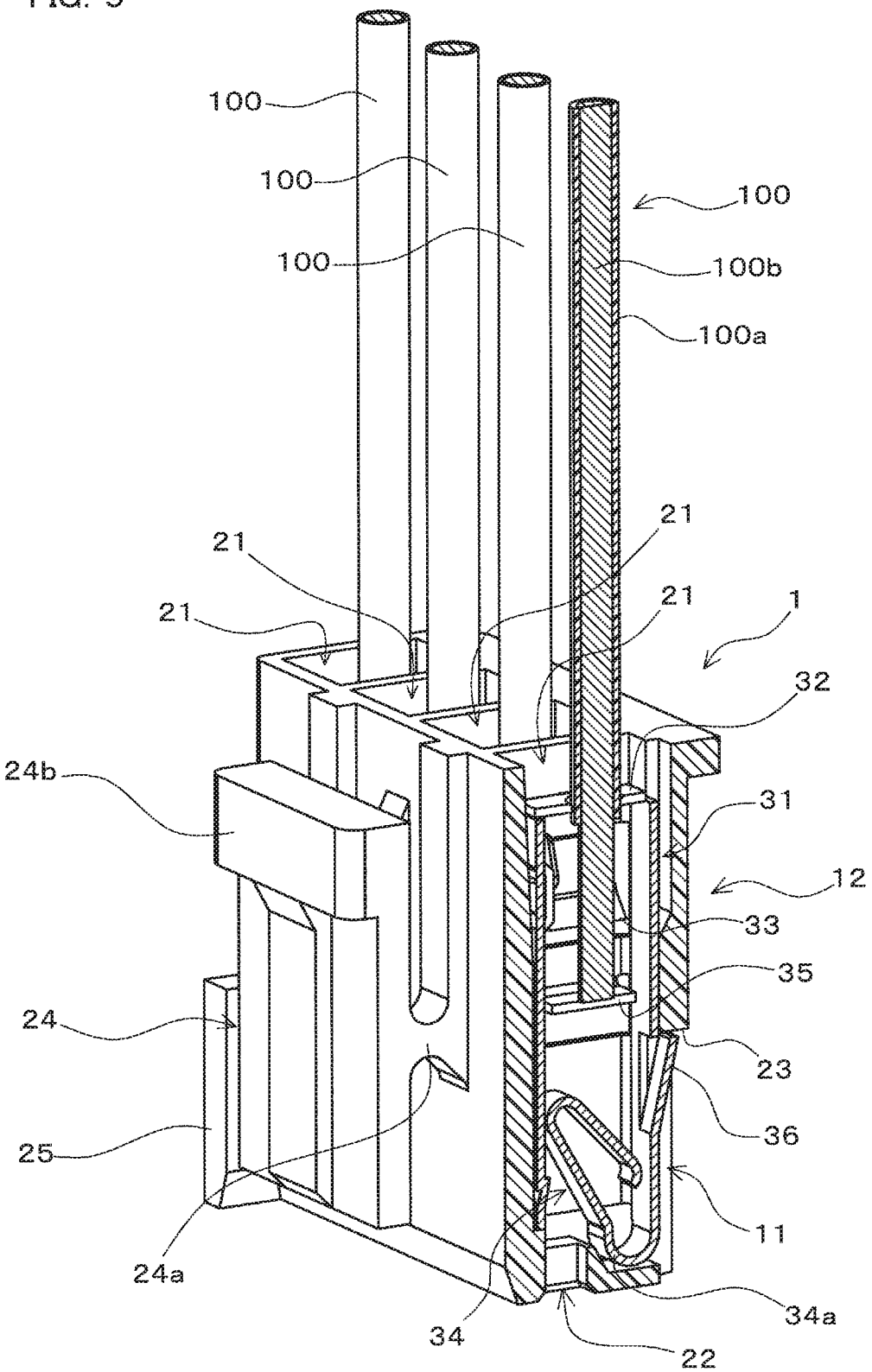
FIG. 9 is a perspective view of a cross-section of the electrical connector, and also shows electrical wires.

FIG. 9 is a perspective view of a cross-section of the electrical connector 1, and also shows the electrical wire 100. Note that only a portion of the electrical wire 100 is shown in FIG. 9. The partner connection portion 34 shown in FIGS. 2, 5A to 7C, and 9 is provided in the main body portion 31, and is configured as a portion for electrically connection to the partner terminal 102. When the terminal 11 is mounted to the housing 12 by being inserted into the insertion hole 21 of the housing 12, the partner connection portion 34 comes into contact with the partner terminal 102 inserted through the terminal connection hole 22 of the housing 12. Accordingly, the partner connection portion 34 is electrically connected to the partner terminal 102.

The partner connection portion 34 is integrated with the main body portion 31 in an end portion of the main body portion 31 on the side opposite to the end portion on the electrical wire insertion portion 32 side. Note that an opening for insertion of the partner terminal 102 is provided in the end portion of the main body portion 31 in which the partner connection portion 34 is provided. Also, a spring structure 34*a* for ensuring contact pressure force with the partner terminal 102 is provided in the partner connection portion 34. Note that in the present embodiment, the spring structure 34*a* is configured as a plate spring-shaped spring structure that is bent in a half-circle shape over approximately 180 degrees.

The positioning portion 35 shown in FIGS. 6A to 9 is provided in the main body portion 31, and is configured as a portion that abuts against and positions the leading end portion of the conductive body 100*b* of the electrical wire 100 inserted into the insertion opening 32*a*. The positioning portion 35 has a configuration including a pair of abutting portions 35*a* and 35*b* that are arranged inside the main body portion 31, in an intermediate portion in the longitudinal direction of the main body portion 31 (see FIG. 8).

The pair of abutting portions 35*a* and 35*b* are provided as portions inside the main body portion 31 for abutting against the leading end portion of the conductive body 100*b* of the electrical wire 100 inserted into the insertion opening 32*a*. The pair of abutting portions 35*a* and 35*b* are provided as plate-shaped portions that extend in a cantilevered manner inward in the main body portion 31 from a pair of opposing wall portions 41*a* and 41*b* of the main body portion 31. Also, the pair of abutting portions 35*a* and 35*b* are provided as plate-shaped portions that extend along a direction perpendicular to the longitudinal direction of the main body portion 31. For this reason, when the conductive body 100*b* of the electrical wire 100 is inserted through the insertion opening 32*a* into the main body portion 31 along the longitudinal direction of the main body portion 31, the leading end portion of the conductive body 100*b* abuts against the pair of abutting portions 35*a* and 35*b*. Accordingly, the position of the leading end portion of the electrical wire 100 connected to the terminal 11 is fixed.

The engaging portion 36 shown in FIGS. 6, 7A to 7C, and 9 is provided in the main body portion 31, and is configured as a portion that has a plate spring-shaped portion extending in a cantilevered manner and that engages with the housing 12 from a position inward of the insertion hole 21 in the housing 12. More specifically, the engaging portion 36 has a plate spring-shaped portion that extends in a cantilevered manner from the main body portion 31 toward the outside of the main body portion 31 in a direction inclined relative to the longitudinal direction of the main body portion 31. The engaging portion 36 is configured so as to be fitted into and engaged with the engaged portion 23 of the housing 12 in a loose-fit state when the terminal 11 is mounted to the housing 12 by being inserted into the insertion hole 21 of the housing 12. Note that the present embodiment illustrates an example of the engaging portion 36 that is formed by cutting a portion of the bottom wall portion 42 of the main body portion 31 and raising it toward the outside of the main body portion 31, and that protrudes diagonally outward from the bottom wall portion 42.

When the terminal 11 is inserted into the insertion hole 21 of the housing 12, the plate spring-shaped engaging portion 36, which extends in a cantilevered manner, temporarily bends toward the inside of the main body portion 31. When the terminal 11 is further inserted into the insertion hole 21, and the engaging portion 36 arrives at an open region formed on the back face side of the housing 12, the engaging portion 36 then undergoes elastic recovery. The engaging portion 36 is thus fitted into, in a loose-fit state, and engages with the engaged portion 23 provided as the edge portion of an open region formed on the back face side of the housing 12.

The hook portion 37 shown in FIGS. 5A to 7C is provided as a hook-shaped portion for maintaining the shape of the main body portion 31 that has an approximately rectangular tube-shaped basic outer form. As previously described, the terminal 11 is formed by, for example, bending a single metal plate that has been appropriately subjected to punch processing, cutting processing, and the like. For this reason, there is a risk that the main body portion 31 of the terminal 11 will become displaced in a direction in which the approximately rectangular tube-shaped portion of the main body portion 31 spreads open due to the influence of elastic recovery after bend processing, or the influence of an external force. To address this, the hook portion 37 is integrated with the main body portion 31, and is provided as a hook-shaped portion that restricts displacement in a direction in which the approximately rectangular tube-shaped portion of the main body portion 31 spreads open. For this reason, the terminal 11 is provided with the hook portion 37, thus maintaining the shape of the main body portion 31 that has an approximately rectangular tube-shaped basic outer form regardless of the influence of elastic recovery after bending processing, or the influence of an external force.

Operations of Terminal and Electrical Connector

The following is a more detailed description of the operation of the terminal 11 during connection of the terminal 11 and the electrical wire 100, the operation of the terminal 11 during mounting of the terminal 11 to the housing 12, and the operations of the terminal 11 and the electrical connector 1 during connection of the electrical connector 1 and the partner connector 101.

When the terminal 11 and the electrical wire 100 are to be connected, the leading end portion of the electrical wire 100 is inserted into the insertion opening 32*a* in the electrical wire insertion portion 32 of the main body portion 31 of the terminal 11 (see FIGS. 5A and 5B). The leading end portion of the electrical wire 100, which has been inserted into the insertion opening 32*a*, is inserted to the deep side of the main body portion 31 while the insertion direction is guided inside the main body portion 31 by the insertion opening 32*a*, and the leading end portion is inserted to a position between the pair of contact spring portions 39*a* and 39*b* inside the main body portion 31 (see FIG. 8). After being inserted to a position between the pair of contact spring portions 39*a* and 39*b*, the leading end portion of the electrical wire 100 is then inserted farther to the deep side beyond the position between the pair of contact spring portions 39*a* and 39*b* in the main body portion 31, and thus abuts against the pair of abutting portions 35*a* and 35*b* of the positioning portion 35 (see FIG. 8). Accordingly, the position of the leading end portion of the electrical wire 100 connected to the terminal 11 is fixed, and the operation of insertion of the electrical wire 100 into the main body portion 31 is complete.

Also, in the state where the operation of insertion of the electrical wire 100 into the main body portion 31 is complete, and the leading end portion of the electrical wire 100 has been inserted to a position between the pair of contact spring portions 39*a* and 39*b*, the exposed conductive body 100*b* in the leading end portion of the electrical wire 100 is sandwiched between the pair of contact spring portions 39*a* and 39*b*. Also, the conductive body 100*b* in the leading end portion of the electrical wire 100 is in contact with and electrically connected to the pair of electrical contact portions 38*a* and 38*b* on the leading end side of the pair of contact spring portions 39*a* and 39*b* (see FIG. 8). Also, due to being sandwiched by the pair of contact spring portions 39*a* and 39*b*, the electrical wire 100 is held in a state of being fixed to the terminal 11. In this way, by completing the operation of insertion of the electrical wire 100 into the main body portion 31, the terminal 11 and the electrical wire 100 become mechanically and electrically connected, and the connection of the terminal 11 and the electrical wire 100 is complete.

After the terminal 11 and the electrical wire 100 are connected, the terminal 11 connected to the electrical wire 100 is then mounted to the housing 12. Multiple terminals 11 with electrical wires 100 connected thereto are mounted to the housing 12. The terminals 11 are mounted to the housing 12 by the main body portions 31 being inserted into the insertion holes 21 of the housing 12 and thus mounted to the housing 12 (see FIGS. 2, 3, and 9).

When the main body portion 31 of each terminal 11 is inserted into the insertion hole 21, the engaging portion 36 of the terminal 11 is fitted into and engaged with the engaged portion 23 of the housing 12 in a loose-fit state. For this reason, when the terminal 11 is inserted into and mounted to the housing 12, the terminal 11 is held in the housing 12 in a loose-fit state and in a retained state. When the terminals 11 are inserted into the insertion holes 21 of the housing 12 and held in the housing 12, the operation of mounting the terminals 11 to the housing 12 is complete. Also, when the terminals 11 with the electrical wires 100 connected thereto are mounted to the housing 12, the operation of connection of the electrical wires 100 and the electrical connector 1 is also complete.

Note that although the above describes an example in which the terminals 11 with the electrical wires 100 connected thereto are inserted into and mounted to the housing 12, there is no limitation to this. The terminals 11 may be connected to the electrical wires 100 after being inserted into and mounted to the housing 12.

Also, although FIGS. 1, 2, and 9 show an example in which all of the terminals 11 are inserted into and mounted to the housing 12, there is no limitation to this. An aspect is possible in which a portion of the terminals 11 are inserted into and mounted to the housing 12. More specifically, an aspect is possible in which terminals 11 are inserted into and mounted to only some of the insertion holes 21 of the housing 12. For example, in the case where four insertion holes 21 are provided in the housing 12 as with the electrical connector 1 shown in FIGS. 1, 2, and 9, terminals 11 may be inserted into and mounted to only some (first to third insertion holes 21) of the four insertion holes 21. In this way, by mounting terminals 11 to only some of the insertion holes 21, it is possible to connect terminals 11 to the partner terminal 102 in accordance with only the circuits that need to be formed when connecting the electrical connector 1 and the partner connector 101.

When multiple terminals 11 have been mounted to the housing 12, and multiple electrical wires 100 have been connected to the electrical connector 1, the operation of connecting the electrical connector 1 and the partner connector 101 is then performed (see FIGS. 1 and 2). When connecting the electrical connector 1 and the partner connector 101, the housing 12 is connected to the terminal block 103 while deforming the pair of connection guides 25 of the housing 12 in the up-down direction so as to slide along the edge portions on the two width direction sides of the terminal block 103. When the pair of the connection guides 25 are slid in the up-down direction along the terminal block 103 and the housing 12 is relatively displaced to the deep side of the terminal block 103, the engaging protrusion portion 24*c* of the lock arm 24 of the housing 12 engages with the housing lock portion 103*a* of the terminal block 103. Accordingly the housing 12 and the terminal block 103 are mechanically connected.

Also, when the housing 12 and the terminal block 103 are connected as described above, the partner terminals 102 of the partner connector 101 are inserted into the insertion holes 21 inside the housing 12 via the terminal connection holes 22 of the housing 12. After being inserted into the housing 12 through the terminal connection holes 22, the partner terminals 102 come into contact with the partner connection portions 34 of the terminals 11 that have been mounted to the housing 12 by being inserted into the insertion holes 21 of the housing 12. Accordingly, the partner connection portions 34 are electrically connected to the partner terminals 102, and the terminals 11 are electrically connected to the partner terminals 102. Note that the partner connection portions 34 are provided with the spring structures 34*a*, thus ensuring contact pressure force between the partner connection portions 34 and the partner terminals 102, and ensuring a stable electrical connection between the terminals 11 and the partner terminals 102.

Note that although the above describes an example of a case in which the electrical wires 100 connected to the electrical connector 1 are all the same type of electrical wire 100, there is no limitation to this. For example, an aspect is possible in which different types of electrical wires are connected to the electrical connector 1. Also, although the above describes an example in which multiple terminals 11 of the same type are mounted to the housing 12, there is no limitation to this. For example, an aspect is possible in which a terminal 11 is mounted to the housing 12 along with a type of terminal that is different from the terminal 11.

Figure 10:
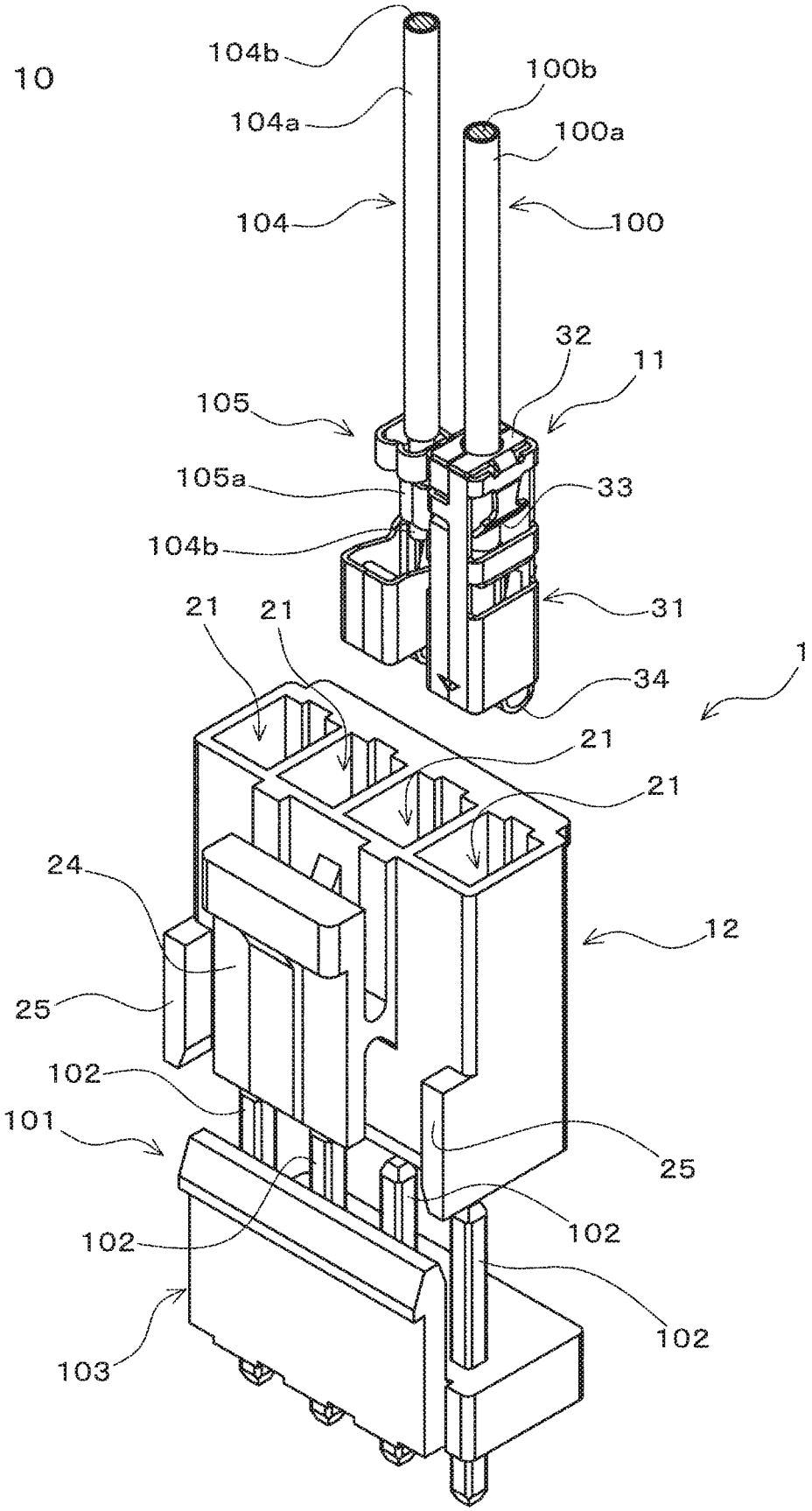
FIG. 10 is a perspective view of the electrical connector in a separated state, and also shows the partner connector.

FIG. 10 is a perspective view of the electrical connector 1 in a separated state, and also shows the partner connector 101. FIG. 10 shows an example in which electrical wires 100 and 104, which are different types of electrical wires, are connected to the electrical connector 1. Also, FIG. 10 shows an example in which the terminal 11 is mounted to the housing 12 along with a crimp terminal 105, which is a different type of terminal from the terminal 11.

Note that the electrical wire 104 has a configuration including a conductive body 104*b*, which is constituted as a metal member having electrical conductive properties, and a covering portion 104*a*, which surrounds the conductive body 104*b* and is constituted by a rubber material or the like having insulating properties. The conductive body 104*b* of the electrical wire 104 is constituted as a twisted wire that is formed by twisting together multiple metal strands. Also, in the leading end portion of the electrical wire 104, a portion of the covering portion 104*a* has been removed so as to expose the conductive body 104*b* to the outside. The crimp terminal 105 is constituted as a terminal that is connected to the electrical wire 104 by press-fitting. The crimp terminal 105 is provided with a crimp portion 105*a* that is crimped and press-fitted to the conductive body 104*b* in the leading end portion of the electrical wire 104. In other words, the crimp terminal 105 is crimped and connected to the electrical wire 104 by the crimp portion 105*a* being crimped to the conductive body 104*b* in the leading end portion of the electrical wire 104.

In the aspect shown in FIG. 10, the terminal 11 connected to the electrical wire 100 and the crimp terminal 105 connected to the electrical wire 104 are mounted to the housing 12. The terminal 11 is mounted to the housing 12 by being inserted into an insertion hole 21 of the housing 12, and the crimp terminal 105 is also mounted to the housing 12 by being inserted into an insertion hole 21 of the housing 12. In this way, an aspect is possible in which the different types of electrical wires 100 and 104 are connected to the electrical connector 1. Also, an aspect is possible in which a terminal 11 is mounted to the housing 12 along with the crimp terminal 105, which is a type of terminal that is different from the terminal 11.

Actions and Effects of Present Embodiment

According to the present embodiment, the terminal 11 has a configuration including the main body portion 31 that is to be inserted into the housing 12, and the main body portion 31 is provided with the electrical wire insertion portion 32 that receives insertion of the electrical wire 100, the conductive body connection portion 33 that is to be connected to the conductive body 100*b* of the inserted electrical wire 100, and the partner connection portion 34 that is to be connected to the partner terminal 102. For this reason, the present embodiment enables realizing, with a simple structure, the terminal 11 for the electrical connector 1, which is used for connection to the partner terminal 102 in a state of being connected to the electrical wire 100 and mounted to the housing 12 of the electrical connector 1. Therefore, according to the present embodiment, it is possible to suppress an increase in the complexity and size of the terminal structure. Also, the terminal 11 can be configured by a single component that includes the main body portion 31, which is provided with the electrical wire insertion portion 32, the conductive body connection portion 33, and the partner connection portion 34. Therefore, according to the terminal 11 of the present embodiment, it is possible to also suppress an increase in the number of parts.

Also, according to the present embodiment, the terminal 11 can be mounted to the housing 12 by merely inserting the main body portion 31, which is provided with the electrical wire insertion portion 32, the conductive body connection portion 33, and the partner connection portion 34, into the housing 12. Therefore, according to the present embodiment, the terminal 11 can be easily mounted to the housing 12. Furthermore, according to the terminal 11 of the present embodiment, the operation of connecting the terminal 11 and the electrical wire 100 can be easily performed by inserting the leading end portion of the electrical wire 100 into the insertion opening 32*a* of the electrical wire insertion portion 32 in the end portion of the main body portion 31 of the terminal 11, and connecting the conductive body 100*b* of the electrical wire 100 to the conductive body connection portion 33 provided in the main body portion 31. Also, movement of the electrical wire 100, which is connected to the terminal 11, in a direction perpendicular to the direction of insertion of the electrical wire 100 into the insertion opening 32*a* is restricted in the electrical wire insertion portion 32 in the end portion of the main body portion 31 of the terminal 11. For this reason, it is possible to suppress instability of the connection state between the terminal 11 and the electrical wire 100 caused by the electrical wire 100 connected to the terminal 11 becoming excessively displaced from the terminal 11, and it is possible to maintain a stable connection state between the terminal 11 and the electrical wire 100.

As described above, according to the present embodiment, it is possible to provide the terminal 11 that can suppress an increase in the complexity and size of the terminal structure, also suppress an increase in the number of parts, and furthermore be easily connected to the electrical wire 100 and easily mounted to the housing 12. Also, according to the present embodiment, it is possible to provide the electrical connector 1 that includes the terminal 11 that can suppress an increase in the complexity and size of the terminal structure, also suppress an increase in the number of parts, and furthermore be easily connected to the electrical wire 100 and easily mounted to the housing 12.

Also, according to the present embodiment, the insertion opening 32*a*, which receives insertion of the leading end portion of the electrical wire 100, is provided as a through-hole in the end portion of the main body portion 31 of the terminal 11. For this reason, when the operation of connecting the electrical wire 100 to the terminal 11 is performed, it is sufficient to insert the leading end portion of the electrical wire 100 into the through-hole in the end portion of the terminal 11. For this reason, the operation of connecting the terminal 11 and the electrical wire 100 can be performed more easily. Also, the insertion opening 32*a* for receiving insertion of the electrical wire 100 is provided as a through-hole, thus making it possible to realize a structure for the insertion opening 32*a* that enables easily guiding the leading end portion of the electrical wire 100 when the leading end portion of the electrical wire 100 is inserted therein. Accordingly, it is possible to realize the terminal 11 that achieves easily guiding the leading end portion of the electrical wire 100, and easily inserting and connecting the electrical wire 100.

Also, according to the present embodiment, the conductive body connection portion 33 has a configuration including the pair of contact spring portions 39*a* and 39*b* that extend in a cantilevered manner and are provided with the electrical contact portions 38*a* and 38*b* on the respective leading end sides. Also, the conductive body 100*b* in the leading end portion of the electrical wire 100, which has been inserted into the insertion opening 32*a* in the end portion of the main body portion 31 of the terminal 11, is sandwiched by the pair of contact spring portions 39*a* and

39*b* inside the main body portion 31, and comes into contact with the electrical contact portions 38*a* and 38*b* on the leading end sides of the pair of contact spring portions 39*a* and 39*b*, thus being electrically connected to the terminal 11. For this reason, the electrical wire 100 inserted into the insertion opening 32*a* of the main body portion 31 of the terminal 11 can be easily connected to the conductive body connection portion 33 inside the main body portion 31, and the electrical wire 100 and the conductive body connection portion 33 can be connected in a more secure and stable state.

Also, according to the present embodiment, it is possible to easily position the electrical wire 100 relative to the terminal 11 by merely inserting the electrical wire 100 into the insertion opening 32*a* in the end portion of the main body portion 31 of the terminal 11, and inserting the electrical wire 100 into the terminal 11 to a position at which the leading end portion of the conductive body 100*b* of the electrical wire 100 abuts against the positioning portion 35 provided in the main body portion 31. For this reason, according to the present embodiment, it is possible to realize a structure for easily performing positioning by inserting the electrical wire 100 to an appropriate position in the terminal 11.

Also, according to the electrical connector 1 of the present embodiment, the engaging portion 36, which has a plate spring-shaped portion in the main body portion 31 of the terminal 11, engages with the housing 12 from a position inward of the insertion hole 21 of the housing 12. For this reason, when the terminal 11 is inserted into and mounted to the housing 12, the terminal 11 can be easily held in the housing 12 in a state of being prevented from coming out of the housing 12. Also, the engaged portion 23 of the housing 12 is configured such that the engaging portion 36 of the terminal 11 is fitted therein and engaged therewith in a loose-fit state. Accordingly, when the electrical connector 1 is connected to the partner connector 101, and the terminal 11 in the electrical connector 1 is connected to the partner terminal 102 in the partner connector 101, the terminal 11 can be displaced inside the housing 12 in accordance with the positional relationship with the partner terminal 102. For this reason, when connecting the terminal 11 and the partner terminal 102, the terminal 11 can be displaced in the housing 12 so as to guide the partner terminal 102 according to the positional relationship with the partner terminal 102, and the terminal 11 and the partner terminal 102 can be easily connected. Accordingly, even if an amount of shift within the tolerance arises in the positional relationship between the terminal 11 and the partner terminal 102, it is possible to easily absorb that amount of shift and easily connect the terminal 11 and the partner terminal 102.

Variations

Although an embodiment of the present invention is described above, the present invention is not limited to the above embodiment, and various modifications can be made without departing from the description of the claims. In other words, the present invention is not limited to the above embodiment, and all modifications, applications, and equivalents thereof that fall within the claims, for which modifications and applications would become naturally apparent by reading and understanding the present specification, are intended to be embraced in the claims of the invention. For example, modifications such as the following may be implemented.

(1) In the above embodiment, the partner connector for connection to a substrate is described as an example of the partner connector for connection to the electrical connector, but there is no limitation to this. The partner connector for connection to the electrical connector may be a partner connector that is for connection to electrical wires other than the electrical wires described above.

(2) In the above embodiment, an example is described in which the housing is provided with multiple insertion holes for insertion of the main body portions of terminals, and the housing is an electrical connector that holds multiple terminals, but there is no limitation to this. An aspect of the electrical connector is possible in which the housing is provided with one insertion hole for insertion of the main body portion of a terminal, and the housing holds one terminal.

(3) In the above embodiment, an example is described in which the electrical connector has a configuration in which the engaging portion of the terminal is fitted into and engaged with the engaged portion of the housing in a loose-fit state, but there is no limitation to this. Instead of an aspect of the electrical connector in which the terminal is held in the housing in a loose-fit state, an aspect of the electrical connector is possible in which the terminal is fixed to and held in the housing in a state where relative displacement is not possible. For example, an aspect of the electrical connector is possible in which the main body portion of the terminal is mounted to the housing by the main body portion of the terminal being press-fitted and inserted into an insertion hole of the housing, and thereby the terminal is fixed to and held in the housing in a state where relative displacement is not possible.

(4) In the above embodiment, an example is described in which the insertion opening of the electrical wire insertion portion of the terminal is constituted as a circular through-hole, but there is no limitation to this. An aspect is possible in which the terminal has an electrical wire insertion portion in which the insertion opening is constituted as a through-hole having a non-circular shape. Also, in the above embodiment, an example of the electrical wire insertion portion is described in which the insertion opening is constituted as a through-hole having a hole diameter that corresponds to the diameter dimension of the electrical wire, but there is no limitation to this. An aspect is possible in which the terminal has an electrical wire insertion portion in which the insertion opening is constituted as a through-hole having a hole diameter sufficiently larger than the diameter dimension of the electrical wire.

(5) Also, although the above embodiment describes an example in which the insertion opening of the electrical wire insertion portion is constituted as a through-hole, there is no limitation to this. An aspect of the terminal is possible in which the electrical wire insertion portion is configured to define an insertion opening that is not a through-hole. For example, an aspect is possible in which the terminal has an electrical wire insertion portion in which the insertion opening for insertion of the electrical wire is constituted as an insertion opening that is shaped as a recessed groove. In this case, the insertion opening may be constituted as an insertion opening that is shaped as a recessed groove and is formed such that the inserted electrical wire can be fitted therein in a state of being engaged in a loose-fit state.

(6) In the above embodiment, an example is described in which the electrical wire insertion portion, which is configured to restrict movement of the electrical wire in a direction perpendicular to the direction of insertion of the electrical wire into the insertion opening, does not directly hold the electrical wire, but there is no limitation to this. The electrical wire insertion portion may be configured to directly hold the electrical wire inserted into the insertion opening.

For example, an aspect is possible in which the electrical wire insertion portion is provided with a spring portion that clamps and holds the electrical wire inserted into the insertion opening. In this way, an aspect is possible in which the electrical wire insertion portion is configured to restrict movement of the electrical wire in the direction perpendicular to the direction of insertion of the electrical wire into the insertion opening by holding the electrical wire inserted into the insertion opening.

(7) In the above embodiment, an example is described in which the main body portion of the terminal has an approximately rectangular tube-shaped basic outer form, but there is no limitation to this. An aspect is possible in which the terminal includes a main body portion that has a basic outer form other than an approximately rectangular tube shape. For example, an aspect is possible in which the terminal includes a main body portion having a basic outer form that has a pair of wall portions and a bottom wall portion that connects the pair of wall portions, and does not have an upper wall portion.

(8) In the above embodiment, an example is described in which the conductive body connection portion has a configuration including the pair of contact spring portions that are provided with the electrical contact portions on the respective leading end sides, but there is no limitation to this. It is sufficient that the conductive body connection portion is electrically connected to the conductive body of the electrical wire inserted into the insertion opening. For example, an aspect is possible in which the conductive body connection portion has a configuration including one contact spring portion provided with an electrical contact portion on the leading end side. Also, an aspect is possible in which the conductive body connection portion has a claw portion that is inserted inward of the covering portion of the electrical wire by deforming so as to be pressed into the electrical wire inserted into the insertion opening, thus digging into the conductive body of the electrical wire.

(9) In the above embodiment, an example is described in which the partner connection portion has the plate spring-shaped spring structures that are bent in a half-circle shape over approximately 180 degrees, but there is no limitation to this. It is sufficient that the partner connection portion is constituted as a portion that is electrically connected to the partner terminal in the terminal. The shape of the partner connection portion may be modified in various ways according to the shape of the partner terminal. Also, it is sufficient that the shape of the partner connection portion is a shape that comes into contact with the partner terminal and generates contact pressure force along with the partner terminal. For example, an aspect is possible in which the partner connection portion has a pair of contact spring portions that come into contact with the partner terminal. Also, an aspect is possible in which the partner connection portion has a plate spring-shaped spring portion and a half sphere-shaped protrusion portion that is provided on the spring portion and comes into contact with the partner terminal.

INDUSTRIAL APPLICABILITY

The present invention is broadly applicable to a terminal for an electrical connector, which is used for connection to a partner terminal in a state of being connected to an electrical wire and mounted to a housing of the electrical connector, and also to an electrical connector that includes this terminal.

What is claimed is:

1. A terminal for an electrical connector, the terminal being used for connection to a partner terminal in a state of being connected to an electrical wire and mounted to a housing of the electrical connector, the terminal comprising:

a main body portion configured to be mounted to the housing by being inserted into the housing;

an electrical wire insertion portion that is provided in an end portion of the main body portion, defines an insertion opening into which a leading end portion of the electrical wire is to be inserted, and is configured to restrict movement of the electrical wire in a direction perpendicular to a direction of insertion of the electrical wire into the insertion opening;

a conductive body connection portion that is provided in the main body portion and is configured to be electrically connected to a conductive body of the electrical wire inserted into the insertion opening of the electrical wire insertion portion and further inserted into the conductive body connection portion; and a partner connection portion that is provided in the main body portion and is configured to be electrically connected to the partner terminal, wherein the partner connection portion is, in its entirety, integral to the main body portion.

2. The terminal according to claim 1, wherein the insertion opening is provided as a through-hole in the end portion of the main body portion.

3. The terminal according to claim 1, wherein the conductive body connection portion includes an electrical contact portion that is provided inside the main body portion and is configured to come into contact with and be electrically connected to the conductive body, and a pair of contact spring portions that are provided as plate spring-shaped portions extending in a cantilevered manner inward in the main body portion from a pair of opposing wall portions of the main body portion, and are configured to sandwich, from two sides, the conductive body of the electrical wire inserted into the insertion opening, and the electrical contact portion is provided at a leading end side of each of the contact spring portions that extend in a cantilevered manner.

4. The terminal according to claim 1, further comprising a positioning portion that is provided in the main body portion and is configured to abut against and position a leading end portion of the conductive body of the electrical wire inserted into the insertion opening.

5. An electrical connector comprising:

the terminal according to claim 1; and a housing that has an insertion hole into which the main body portion of the terminal is to be inserted, and is configured to hold the terminal inserted into the insertion hole.

* * * * *